US006568102B1

(12) United States Patent
Healy et al.

(10) Patent No.: US 6,568,102 B1
(45) Date of Patent: May 27, 2003

(54) SHOE HAVING SHOCK-ABSORBER ELEMENT IN SOLE

(75) Inventors: John A. Healy, Madbury, NH (US); Craig Wojcieszak, Stratham, NH (US)

(73) Assignee: Converse Inc., North Reading, MA (US)

( * ) Notice: Subject to any disclaimer, the term of this patent is extended or adjusted under 35 U.S.C. 154(b) by 0 days.

(21) Appl. No.: 09/511,921

(22) Filed: Feb. 24, 2000

(51) Int. Cl.[7] ..... A43B 13/18
(52) U.S. Cl. ..... 36/28; 36/35 R; 36/27
(58) Field of Search ..... 36/28, 27, 29, 36/35 R, 35 B

(56) References Cited

U.S. PATENT DOCUMENTS 4,262,433 A * 4/1981 Hagg et al.
4,592,153 A * 6/1986 Jacinto
4,730,402 A * 3/1988 Norton et al.
4,887,367 A * 12/1989 Mackness et al.
5,343,639 A * 9/1994 Kilgore et al.
5,461,800 A * 10/1995 Luthi et al.
5,743,028 A * 4/1998 Lombardino
5,822,886 A * 10/1998 Luthi et al.

* cited by examiner

*Primary Examiner*—Ted Kavanaugh
(74) *Attorney, Agent, or Firm*—Thompson Coburn LLP

(57) ABSTRACT

A shoe comprising a sole for supporting a foot of a wearer, and a shoe upper adjacent the sole. The sole includes an upper force-distribution plate portion, a lower force-distribution plate portion spaced below the upper plate portion, and at least one resilient shock-absorber element in contact with and between both the upper and lower plate portions.

17 Claims, 5 Drawing Sheets

SHOE HAVING SHOCK-ABSORBER ELEMENT IN SOLE

BACKGROUND OF THE INVENTION

This invention relates to shoes, and particularly to athletic shoes having shock-absorbing soles for use with rigorous activities such as running or court sports.

A conventional athletic shoe includes an outsole, a midsole, and an upper. Such a shoe is typically designed to reduce the shock felt by the wearer during foot strike. Such reduction in shock is an important consideration in reducing the likelihood of injury by the wearer and in providing comfort to the wearer. Distance runners typically strike the ground at a force equal to 2.5 times their body weight and at a rate of 180 times per minute (90 per each foot). Basketball players can experience vertical forces greater than 10 times body weight and shear forces of twice body weight. In addition to providing cushioning, an athletic shoe should provide a stabilizing mechanism that supports and controls the foot during athletic movements such as forward running, cutting, jumping and landing. Unstable shoes may cause short or long term injury due to the excessive motion at the joints brought on by unstable materials and designs.

The cushioning in most athletic shoes is supplied through a foam midsole made from ethylene vinyl acetate (EVA) or polyurethane (PU). These materials are relatively inexpensive, easily molded, and provide ample cushioning when they are new. Other shoes have used gas-filled and liquid-filled bladders to provide the required cushioning. Both of these shoe constructions provide adequate cushioning when they are new. Fluid filled bladders continue to provide like new cushioning for the life of the shoe, assuming that the fluid remains encapsulated in the shoe. Shoe midsoles made from foams provide adequate cushioning when they are new, but quickly lose some of their cushioning ability when the air cells inside the foam suffer catastrophic failure from the application of vertical and shear forces. EVA foams have compression (compaction) set rates of greater than 50%. This means that the ability to provide cushioning is reduced by at least 50% due to compaction of the material.

In addition to cushioning, a shoe should also supply support and stability. Generally, as the materials used under foot become softer, the support and stability decrease. Harder/firmer materials lend the most support and stability. Since harder/firmer materials decrease the amount of available cushioning, providing adequate cushioning without detracting from support and stability is a challenge that requires attention to detail with respect to material choices and design.

SUMMARY OF THE INVENTION

Among the several objects and advantages of the present invention may be noted the provision of an improved shoe; the provision of a sole for a shoe which provides excellent shock absorption without reducing support and stability; and the provision of such a shoe which is generally light in weight.

Generally, a shoe of the present invention has a sole for supporting a foot of a wearer, and a shoe upper adjacent the sole. The sole includes an upper force-distribution plate portion, a lower force-distribution plate portion spaced below the upper plate portion, and at least one resilient shock-absorber element in contact with and between both the upper and lower plate portions.

In another aspect of the present invention, a shoe comprises a sole for supporting a foot of a wearer, and a shoe upper adjacent the sole. The sole includes an outsole portion spaced below the upper, and a plurality of discrete, resilient, shock-absorber elements. The shock-absorber elements are positioned between the outsole portion and the upper. Each shock-absorber element is generally circular in shape in horizontal cross-section.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
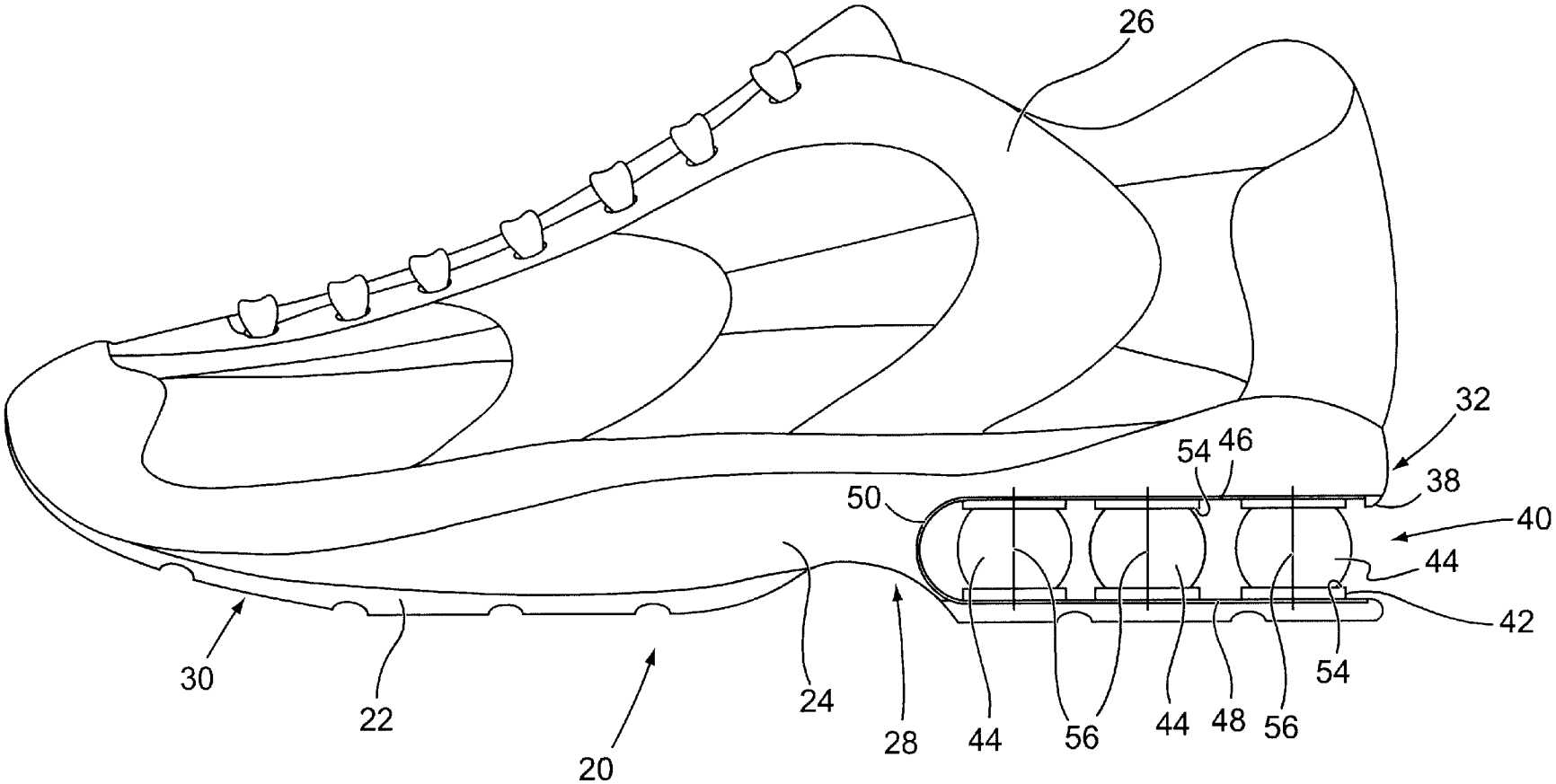
FIG. 1 is a side elevation view of a shoe of the present invention.

Referring now to the drawings, and first more particularly to FIG. 1, a shoe of the present invention is indicated in its entirety by the reference numeral 20. The shoe 20 is preferably an athletic shoe (e.g., a running shoe, basketball shoe, tennis shoe, etc) and includes an outsole, generally indicated at 22, a midsole, generally indicated at 24, and an upper, generally indicated at 26. Preferably, the outsole and midsole 24 are made of conventional outsole and midsole materials. In particular, the outsole 22 is preferably of a durable material, such as carbon rubber, and the midsole is preferably of a cushioning material, such as foam polyurethane or foam ethylene vinyl acetate. The upper 26 may be of leather or other conventional upper materials.

The outsole 22 and midsole 24 comprise a sole, generally indicated at 28. The sole 28 includes a forefoot region, generally indicated at 30, a heel region, generally indicated at 32, a lateral side, generally indicated at 34, and a medial side (shown in FIG. 2), generally indicated at 36. The forefoot region 30, heel region 32, lateral side 34 and medial side 36 correspond to and are adjacent the like portions of a wearer's foot when the wearer wears the shoe. The sole 28 includes a cavity 38, preferably in the heel region 32 of the sole. The cavity 38 is sized and shaped for receiving a heel cushioning assembly 40.

The heel cushioning assembly 40 comprises a shell 42 and a plurality of resilient shock-absorber elements 44. The shell 42 is preferably of a single monolithic piece and comprises an upper force-distribution plate portion 46, a lower force-distribution plateportion 48 spaced below the upper plate portion, and a connecting portion 50 extending between the upper and lower plate portions. The upper and lower force-distribution plate portions 46, 48 are preferably semi-rigid for providing load distribution and stability. The shock-absorber elements 44 are in contact with and between the force-distribution plate portions 46, 48 and provide shock attenuation and cushioning.

Figure 4:
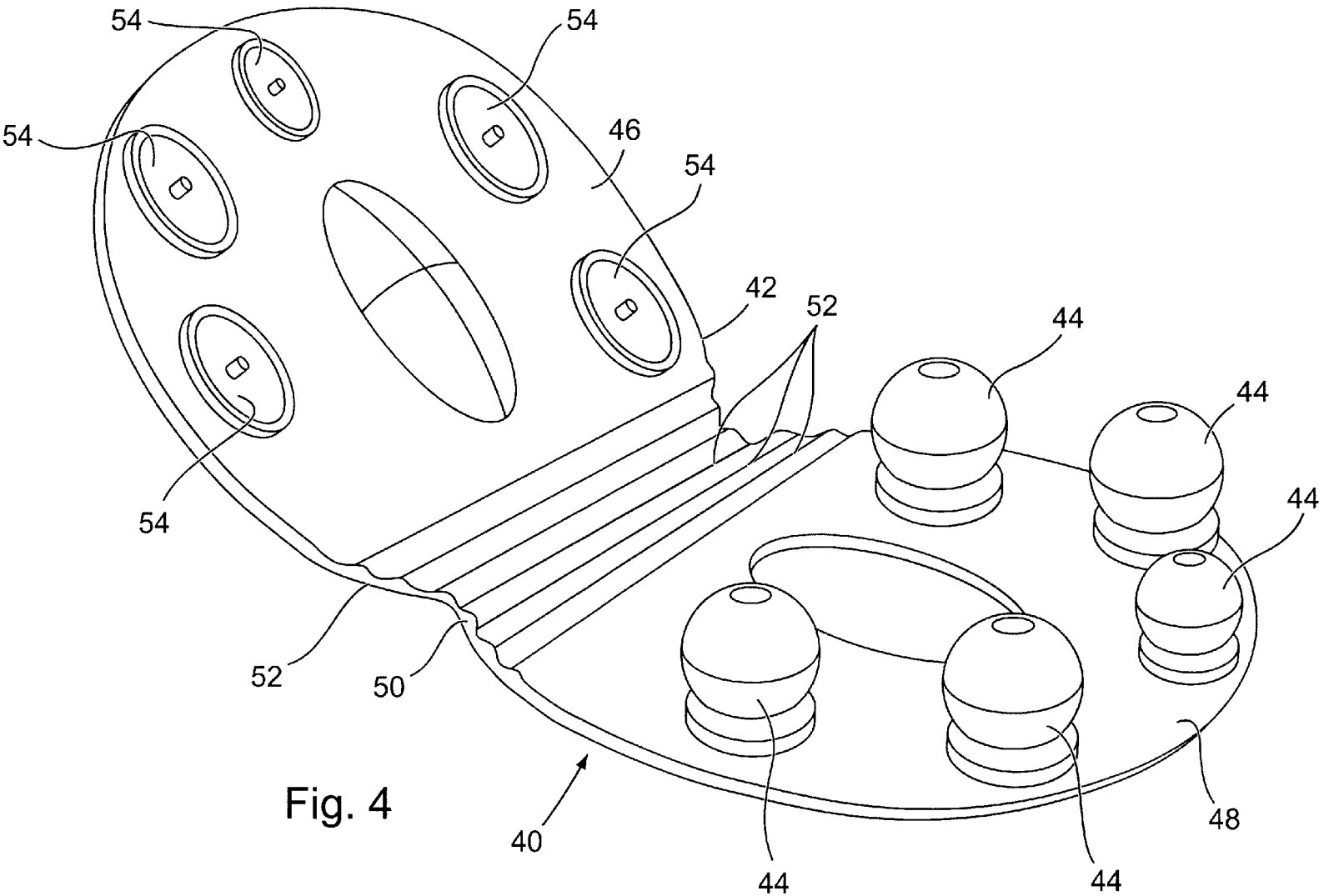
FIG. 4 is a perspective view of the heel cushioning assembly of FIG. 3 with an upper plate portion of the cushioning assembly swung away from shock absorbing elements of the cushioning assembly.

The force-distribution plate portions 46, 48 define the perimeter of the cushioning assembly 40. Preferably, the connecting portion 50 has one or more lateral grooves 52 (FIG. 4) for facilitating bending of the shell 42 at the connecting portion. The final shape of the force-distribution plate may also be achieved through injection molding with appropriate mold tooling. Preferably, the shell 42 is of a single molded piece construction to resist shear forces from acting on the shock-absorbers. The force-distribution plates 46, 48 are sufficiently stiff to provide stability and to transfer the loading forces of the foot to the shock-absorber elements 44. Because the force-distribution plates 46, 48 are of a single component, the connecting portion 50 (preferably curved) may be sufficiently stiffened (via thickness and shape) to provide the necessary resistance to shear forces. Multiple pieces may be employed and bonded together, but pose a risk of separation of the components due to the rigors of athletic activity.

The shell may be of any suitable polymeric material that can be injection or compression molded. Examples are thermoplastic urethane (TPU), Hytrel®, Zytel®, and nylon. More expensive materials such as carbon fiber may also be used to reduce weight but are not necessary to achieve the required mechanical properties. Cost, thermal stability, hardness range, bending resistance and component bonding should all be considered. Preferably, the upper and lower force-distribution plate portions 46, 48 have a durometer hardness of at least 70 shore D in order to achieve the desired hardness to transfer the load to the shock-absorber elements 44. The hardness of the force-distribution plate portions may be varied to increase or decrease stability to meet the requirements of the particular sport or activity. Preferably, the shell 42 has only the upper and lower force-distribution plate portions 46, 48 and the single connecting portion 50. The shell 42 may be molded as a single, relatively flat piece and then formed into the correct geometry. When using this method, the curved portion of the plate should be thermally reset. This will nullify any tensile forces between the shock-absorber elements 44 and the plate portion 46, 48.

The shell 42 of the preferred embodiment is a generally C-shaped component. However, it is to be understood that other shapes may be employed without departing from the scope of this invention. For example, an alternative shell could be of an oval or rectangular shape (i.e., no open end). The open end construction is preferred because with an oval or rectangular geometry, a large portion of the vertical forces would be absorbed in the ends of the opposite closed ends. Thus, the forces are borne largely by the shell as opposed to the shock-absorber elements. With the shell having an open end, the forces are more fully transferred to the shock-absorber elements. This enables the heel cushioning assembly to employ dissimilar materials that are chosen for specific purposes (e.g., relatively harder plastic for stability, and resilient materials for cushioning).

The shock-absorber elements 44 accept shock as transferred from the shell 42. The shock-absorber elements 44 deform as the load is applied, provide resistance to the load, and return to their original shape when the load is removed. Preferably, the shock-absorber elements 44 have durometer hardnesses less than that of the force-distribution plate portions 46, 48. The material choice, hardness, geometry, placement and number of shock-absorber elements will all affect the cushioning response of the heel cushioning assembly. Highly resilient, elastic, deformable materials that do not take a compression set are the most desirable. Examples include thermoplastic urethane, thermoplastic rubber, polybutyidiene, and peebax. Alternatively, the shock-absorber elements 44 may comprise gas-filled or fluid-filled containers as long as they provide the desired stiffness and resiliency.

The geometry of the shock-absorber elements 44 is also important. The vertical and shear forces applied to the shock-absorber elements 44 during use of an athletic shoe often exceed twice a wearer's body weight. Therefore, the shape is preferably conducive to resisting these forces. Shapes that allow the shock-absorber elements 44 to bend or kink are undesirable, as bending or kinking would reduce the resiliency and energy return of the system. Preferably, each shock-absorber element 44 in horizontal cross-section is generally circular in shape. More preferably, each shock-absorber element 44 is generally ellipsoidal in shape and more preferably is generally spherical in shape. A sphere or ball-shaped shock-absorber element 44 provide improved response to vertical and shear loading. The sphere will not bend or kink, but rather will deform until the load is removed at which time it will return to its original spherical shape.

Preferably, the shock-absorber elements 44 are held between opposing sockets 54 formed in the upper and lower plate portions 46, 48. The sockets 54, limit shifting of the shock-absorber elements 44 relative to the plate portions 46, 48.

Figure 2:
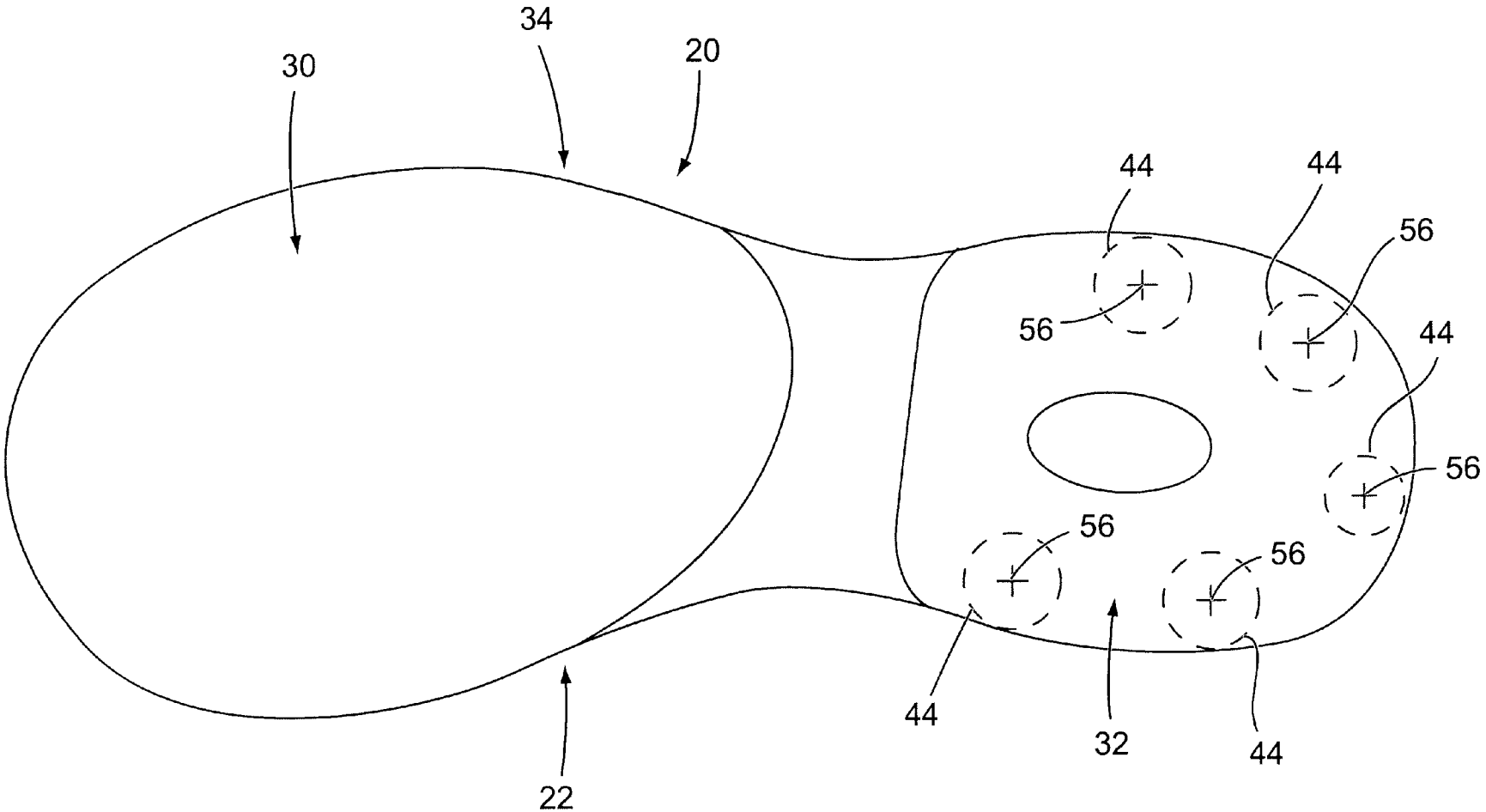
FIG. 2 is a bottom plan view of the midsole of FIG. 1 with the shoe's outsole removed to show detail.
Figure 3:
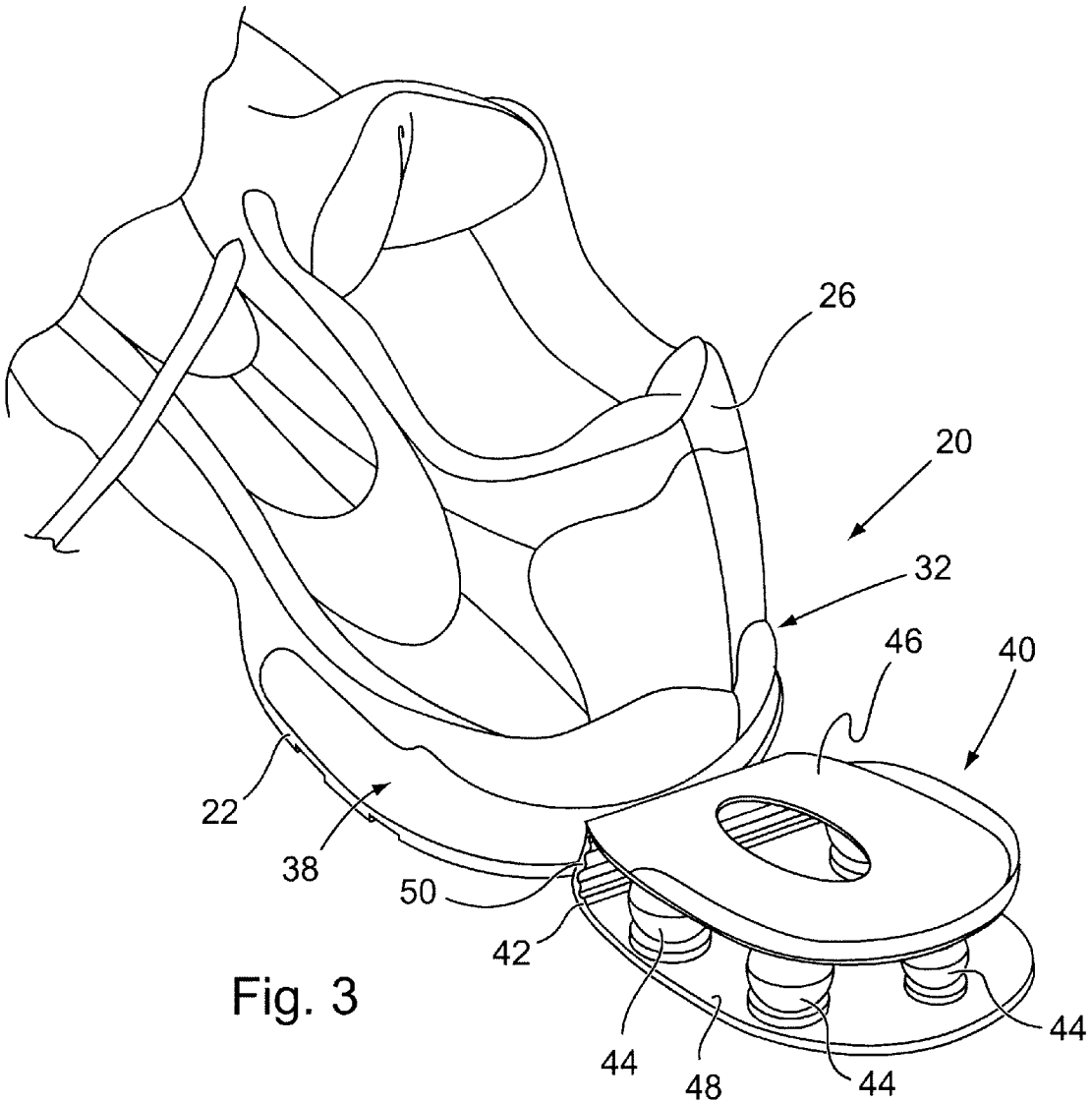
FIG. 3 is a fragmented, exploded, perspective view of the shoe of FIG. 1 showing a heel cushioning assembly of the shoe exploded from a heel region of the shoe.

As shown in FIG. 2, the shock-absorber elements 44 are preferably spaced from one another and positioned about the periphery of the heel region 32 of the sole in a manner so that the unit provides medio-lateral support. In the case of a running shoe, it may be desirable to make the medial side of the heel stiffer than the lateral side. This medio-lateral hardness difference has been shown to reduce over-pronation of the heel, a concern of many runners. This may be accomplished by having the shock-absorber elements adjacent the medial side being of a stiffer material (or geometry) than that of the shock-absorber elements adjacent the lateral side. The medial side 36 of the sole may also be made stiffer than the lateral side by having a greater number of shock-absorber elements along the medial side. Also as shown in FIG. 2, the shock-absorber elements 44 are preferably positioned about the periphery of the heel region of the sole in an asymmetric pattern. Although not shown, it is to be understood that an additional shock-absorber element could be positioned directly in the center of the heel region without departing from the scope of this invention.

As shown in FIG. 1, the heel cushioning assembly 40 further includes a plurality of tension members 56 (FIG. 1) secured to and extending between the upper and lower plate portions 46, 48. The tension members 54 is preferably of a material that has no elongation in tension and no resistance to compressive forces when placed in compression. The tension members 54 may be of a cord, chain, strong thread, etc., and preferably resists a minimum of fifty pounds of force in tension without breaking or significant elongation. Preferably, each tension member 54 extends through a bore in a corresponding one of the shock-absorber elements 44 without the tension member being bonded to the shock-absorber element. The purpose of the tension members 54 is to limit the spacing between the upper and lower plate portions 46, 48. The tension members 54 reduce the tensile load at the bonding surfaces of the upper and lower plate portions 46, 48 and the shock-absorbers. The tension members 54 need not be incorporated into every shock-absorber element 44, but should be employed in enough shock-absorber elements to resist the maximum tensile forces anticipated. In some applications, there will be a need for only one tension member. In other applications, there will be a need for a tension member in every shock-absorber element.

The force-distribution plate portions 46, 48 and the distribution of forces to the shock-absorber elements 44 means that the ground reaction forces developed during foot strike will transfer to the shock-absorber elements via the plate portions. Accordingly, the shock-absorber elements 44 need to be of elastic, dense, energy efficient, durable materials. Use of correct materials ensures minimization of compaction and minimization of reduction of performance with repeated loading. While the use of these elastic, durable materials is an excellent method of providing cushioning properties, the relatively high density of these materials would add too much weight to a typical athletic shoe of used in a homogeneous manner (e.g., use of the material for the entire midsole). Use of the discrete, spaced-apart shock-absorber elements 44, even though of a dense material, creates a light weight shoe with improved properties.

Figure 5:
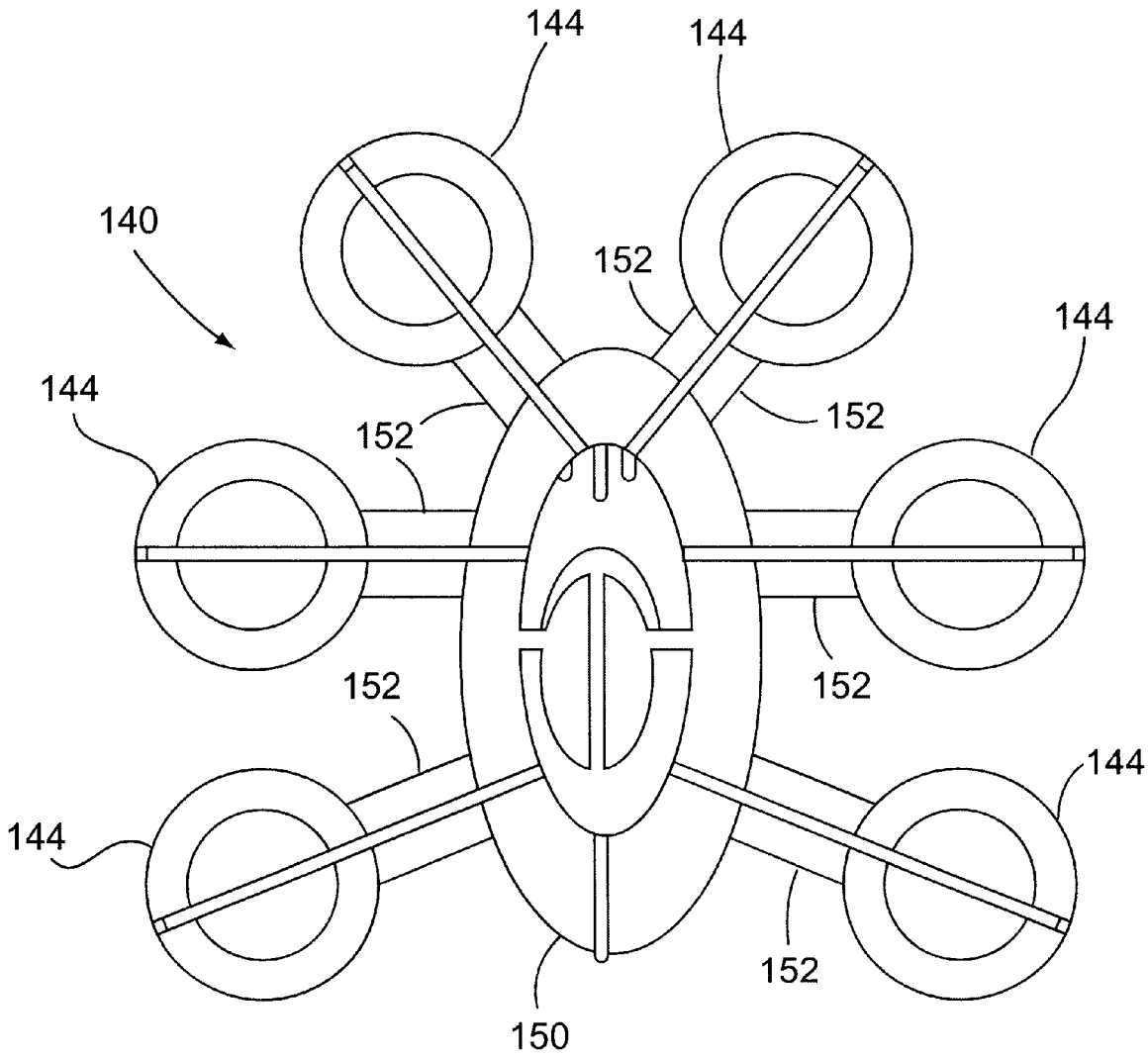
FIG. 5 is a top plan view of shock absorbing elements of another embodiment of a cushioning assembly of the present invention.

Referring now to FIG. 5, another embodiment of a heel cushioning assembly of the present invention is generally indicated at 140. The heel cushioning assembly 140 includes a plurality of shock absorber elements 144, a central fluid chamber 150 and a plurality of conduits 152 extending between the shock absorber elements and the fluid chamber for providing fluid communication therebetween. The conduits 152 also provide fluid communication between the shock-absorber elements. The shock-absorber elements 144 are preferably similar to the shock-absorber elements 44 of FIGS. 1–4 except the shock absorber elements 144 are hollow. The heel cushioning assembly 140 is adapted to contain any suitable fluid such as a gas, a liquid or a gel. Although not shown, it is to be understood that the heel cushioning assembly 144 further includes a shell similar to the shell 142 of FIGS. 1–4.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A shoe comprising:

a sole for supporting a foot of a wearer;

a shoe upper adjacent the sole;

the sole including an upper force-distribution plate portion, a lower force-distribution plate portion spaced below the upper plate portion, and at least two discrete resilient shock-absorber elements, each of said at least two shock-absorber elements being in contact with and between both the upper and lower plate portion, each of the least two shock-absorber elements being generally spherical in shape.

2. A shoe as set forth in claim 1 wherein the shock-absorber elements comprise gas-pressurized chambers.

3. A shoe as set forth in 2 further comprising at least one conduit providing fluid communication between the gas-pressurized chambers.

4. A shoe as set forth in claim 1 wherein the shock-absorber elements comprise fluid-filled chambers.

5. A shoe as set forth in 4 further comprising at least one conduit providing fluid communication between the fluid-pressurized chambers.

6. A shoe as set forth in claim 1 wherein the sole comprises a forefoot region and a heel region generally rearward of the forefoot region, the heel region having a periphery, the at least two resilient shock-absorber elements comprising a plurality of shock-absorber elements positioned about the periphery of the heel region of the sole.

7. A shoe as set forth in claim 6 wherein the sole includes a medial side and a lateral side, the plurality of shock-absorber elements being positioned about the periphery of the heel region of the sole in a manner so that the medial side of the sole is stiffer than the lateral side.

8. A shoe as set forth in claim 7 wherein the plurality of shock-absorber elements comprises at least first and second shock-absorber elements, the first shock-absorber element being adjacent the medial side of the sole and the second shock-absorber element being adjacent the lateral side of the sole, the first shock-absorber element being stiffer than the second shock-absorber element.

9. A shoe as set forth in claim 7 wherein the plurality of shock-absorber elements are positioned about the periphery of the heel region of the sole in an asymmetric pattern.

10. A shoe having:

a sole for supporting a foot or a wearer;

a shoe upper adjacent the sole; and the sole including an outsole portion spaced below the upper, and a plurality of discrete, resilient, shock-absorber elements, the shock-absorber elements being positioned between the outsole portion and the upper, each shock-absorber element being generally spherical in shape.

11. A shoe comprising:

a sole for supporting a foot of a wearer;

a shoe upper adjacent the sole;

the sole including an upper force-distribution plate portion, a lower force-distribution plate portion spaced below the upper plate portion, at one resilient shock-absorber element in contact with and between both the upper and lower plate portions, and at least one tension member secured to and extending between the upper and lower plate portions, the tension member being adapted to resist movement of the first and second plate portions away from one another, the tension member being adapted and configured to provide no resistance to compressive forces when placed in compression, the shock-absorber element being generally ellipsoidal in shape.

12. A shoe comprising:

a sole for supporting a foot of a wearer;

a shoe upper adjacent the sole;

the sole including an upper force-distribution plate portion, a lower force-distribution plate portion spaced below the upper plate portion, at least two discrete resilient shock-absorber elements, and at least one tension member secured to and extending between the upper and lower plate portions, each of said at least two shock-absorber elements being in contact with and between both the upper and lower plate portions, the tension member being adapted to resist movement of the first and second plate portions away from one another, the tension member being adapted and configured so as not to resist movement of the force distribution plates toward one another when the sole is compressed in a manner to move the force distribution plates toward one another.

13. A shoe as set forth in claim 12 wherein each shock-absorber element is of a durometer hardness legs than the durometer hardness of the upper plate portion and less than the durometer hardness of the lower plate portion.

14. A shoe as set forth in claim 13 wherein each of the shock-absorber elements is generally ellipsoidal in shape.

15. A shoe as set forth in claim 12 wherein one of the shock-absorber elements includes a through bore and wherein the tension member extends through the bore.

16. A shoe comprising:

a sole for supporting a foot of a wearer;

a shoe upper adjacent the sole;

the sole including an upper force-distribution plate portion, a lower force-distribution plate portion spaced below the upper plate portion, at least one resilient shock-absorber element in contact with and between both the upper and lower plate portions, and at least one tension member secured to and extending between the upper and lower plate portions, the tension member being adapted to resist movement of the first and second plate portions away from one another, the shock-absorber element being generally ellipsoidal in shape, the shock-absorber element including a through bore and wherein the tension member extends through the bore.

17. A shoe comprising:

a sole for supporting a foot of a wearer, the sole comprising a forefoot region and a heel region generally rearward of the forefoot region, the heel region having a periphery;

a shoe upper adjacent the sole, the sole including an upper force-distribution plate portion, a lower force-distribution plate portion spaced below the upper plate portion, a plurality of resilient shock-absorber elements positioned about the periphery of the heel region of the sole and in contact with and between both the upper and lower plate portions, and at least one tension member secured to and extending between the upper and lower plate portions, the tension member being adapted to resist movement of the first and second plate portions away from one another, the tension member extending through one of the shack-absorber elements.

* * * * *